US006375070B1

(12) United States Patent
Snoke

(10) Patent No.: US 6,375,070 B1
(45) **Date of Patent: *Apr. 23, 2002**

(54) POSTAL DELIVERY APPARATUS AND METHOD OF POSTAL DELIVERY AND RECEIPT

(75) Inventor: Phillip Jack Snoke, Atlanta, GA (US)

(73) Assignee: American Industrial Design Co., Inc., Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/674,553

(22) Filed: Jul. 1, 1996

(51) Int. Cl.[7] ..... A47G 29/124

(52) U.S. Cl. ..... 232/20; 232/24; 232/27; 232/45

(58) Field of Search ..... 232/24, 20, 45, 232/38, 17, 19, 27; 70/215, 161, 168, 172

(56) References Cited

U.S. PATENT DOCUMENTS

| | | | | |
|---|---|---|---|---|
| 402,855 A | | 5/1889 | Paulsen | |
| 664,531 A | | 12/1900 | Chase | |
| 890,766 A | | 6/1908 | Hann | |
| 1,359,412 A | * | 11/1920 | Martin | 232/24 |
| 1,661,728 A | | 3/1928 | Rue | |
| 2,584,435 A | | 2/1952 | Doerr | |
| 2,945,621 A | * | 7/1960 | Kopprasch et al. | 232/24 |
| 4,333,603 A | * | 6/1982 | Carlson | 232/24 X |
| 4,361,271 A | * | 11/1982 | Hester et al. | 232/24 X |
| 4,726,512 A | * | 2/1988 | White | 232/24 X |
| 5,072,852 A | | 12/1991 | Smith et al. | 220/404 |
| D327,767 S | | 7/1992 | Gilbert, Jr. | D99/31 |
| 5,148,974 A | | 9/1992 | Clapper | 232/17 |
| 5,150,834 A | | 9/1992 | Bourke | 232/1 |
| 5,297,674 A | | 3/1994 | Birutis et al. | 206/214 |
| 5,337,953 A | | 8/1994 | Haest | 232/17 |

FOREIGN PATENT DOCUMENTS

| | | |
|---|---|---|
| CH | 597-809 | 4/1978 |
| FR | 2 500 735 | 3/1982 |

* cited by examiner

*Primary Examiner*—Blair M. Johnson
(74) *Attorney, Agent, or Firm*—Allen, Dyer, Doppelt, Milbrath & Gilchrist, P.A.

(57) ABSTRACT

A postal delivery apparatus and method for delivering and removing parcels to residential and commercial customer is provided. The postal delivery apparatus preferably has a base including a bottom, a plurality of outer walls connected to and extending upwardly from the bottom, a substantially hollow portion positioned within inner confines of the outer walls so as to define an inner cavity, and an open upper end positioned for providing access to the inner cavity. At least one of the plurality of outer walls preferably includes a wall opening formed therein for inserting letter-type parcels through the wall opening into the inner cavity of the base. The wall opening preferably is sized and positioned for inhibiting access by a user to letter-type parcels positioned in the inner cavity. A partition is positioned between the plurality of outer walls so as to divide the inner cavity into a first compartment positionally aligned with the wall opening for inserting letter-type parcels therein through the wall opening and a second compartment for inserting larger box-type parcels therein through the open upper end of the base. An outer lid is pivotally connected to upper peripheries of the base, and the outer lid is positioned to overlie the open end of the base and abuttingly contact upper peripheries of the base when in a closed position and positioned to extend upwardly away from the base when in an open position so as to provide access to the first and second compartments through the open end.

20 Claims, 6 Drawing Sheets

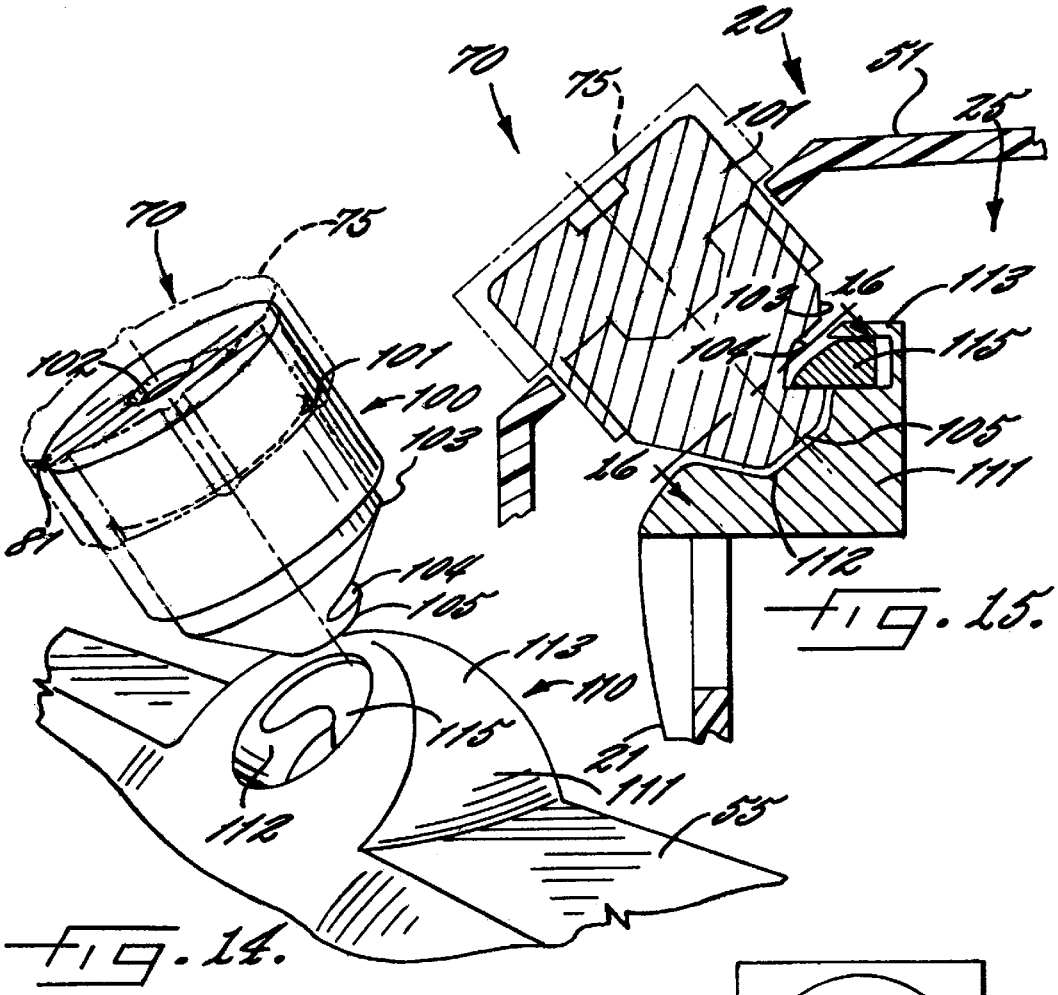
FIG. 15.
FIG. 14.
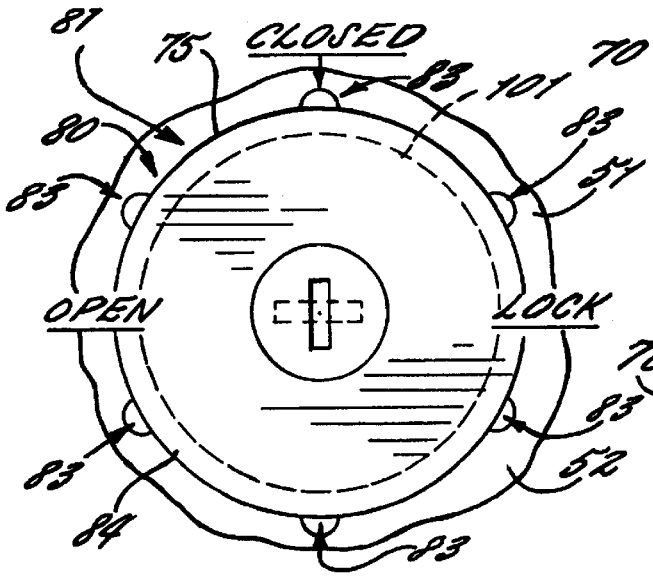
FIG. 18.
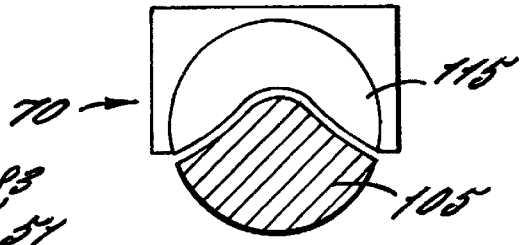
FIG. 16.
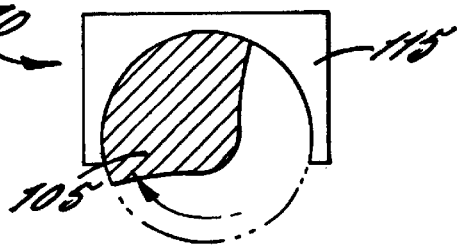
FIG. 17.

POSTAL DELIVERY APPARATUS AND METHOD OF POSTAL DELIVERY AND RECEIPT

FIELD OF THE INVENTION

The present invention relates to the field of postal delivery and, more particularly, to an apparatus and method for positioning postal items therein.

BACKGROUND OF THE INVENTION

Over the years, postal delivery traditionally has been viewed as an honorable field of service to the local communities and the country. Because good postal delivery has been recognized as important to our society, federal laws also have made tampering with mail or interfering with postal duties criminal conduct. These laws for many years greatly inhibited individuals from tampering with or stealing mail from mail boxes, porches, or doorways of residential and commercial customers.

As our society has developed over the years, the mail service has continued to deliver valuable items to residential and commercial customers. Requirements for improved speed of delivery and improved technology has allowed overnight carriers to arise and develop large industries around postal delivery services. Despite the federal criminal laws and the improvements in technology, the postal delivery industry more recently has become and remains hampered by increased criminal conduct related to interfering with, tampering with, or stealing postal items delivered to customers. This criminal conduct is further exacerbated by the overnight and quick delivery of letters and parcels for mail boxes, for example, not equipped to receive them, not equipped to inhibit access by those with criminal intentions, and not equipped to provide a ready drop-off location for postal carriers.

Additionally, for example, the catalog sales and delivery and home shopping television network industries have increased dramatically over the years and particularly with the rise of the quality, less cost, and improved reliability of overnight carrier services. These catalog sales and delivery and home shopping services are used by a variety of residential and commercial customers which often are not at home or are away from their business when a postal delivery occurs. For protection of the letter or parcel being delivered from those with criminal intentions and from various weather conditions, the postal carrier often leaves a note on the door or in a location for the resident or business to find which requires that the resident call to pick up the package or call for a more convenient time of delivery. This process, however, delays receipt of the letter or parcel by the customer and to a certain extent defeats the purpose of overnight or quick delivery ordered by the customer. These problems have caused many customers to rent or lease mailbox services, but these can be expensive and require a customer to travel away from a home or business to pick up a parcel delivery.

OBJECTS AND SUMMARY OF THE INVENTION

With the foregoing in mind, it is an object of the present invention to provide a postal delivery apparatus and method sized for delivery of letters and larger parcels to residential and commercial customers and which inhibits access to the contents of a delivery container by those with criminal intentions.

It is also an object of the present invention to provide a postal delivery apparatus and method which allows postal carriers to easily and readily deliver letters and larger parcels into a delivery container which inhibits access by unauthorized individuals and without extensive delay in the delivery time.

It is another object of the present invention to provide a postal delivery apparatus and method which inhibits damage to contents from various weather conditions to which the postal delivery apparatus may be exposed.

It is still another object of the present invention to provide a postal delivery apparatus and method which inhibits access by unauthorized individuals including children.

It is yet another object of the present invention to provide a postal delivery apparatus and method which inhibits removal and transport of the postal delivery apparatus from a mounting surface.

It is a further object of the present invention to provide a postal delivery apparatus and method having structural strength, being readily manufactured in high volume, and being less expensive than many alternatives.

A postal delivery apparatus and method for more securely delivering and removing parcels of residential and/or commercial customers is provided according to the present invention. For security conscious people, for example, the postal delivery apparatus allows postal carriers to easily and readily deliver letters and larger parcels into a delivery container which inhibits access by unauthorized individuals, including children, and without extensive delay in the delivery time. For example, the postal delivery apparatus also advantageously does not require postal delivery personnel to carry a key or other device to access parcel delivery compartments, particularly for larger parcels which are often shipped by catalog companies to customers. The apparatus also inhibits damage to contents from various weather conditions to which the postal delivery apparatus may be exposed such as when positioned on a porch or patio of a residential customer. Because of the usage of the apparatus, the postal delivery apparatus further has structural strength, is readily manufactured in high volume, and is less expensive than many alternatives.

More particularly, a postal delivery apparatus according to the present invention preferably has a base including a bottom, a plurality of outer walls connected to and extending upwardly from the bottom, a substantially hollow portion positioned within inner confines of the bottom and the outer walls so as to define an inner cavity, and an open upper end positioned for providing access to the inner cavity. At least one of the plurality of outer walls preferably includes a wall opening formed therein for inserting letter-type parcels through the wall opening into the inner cavity of the base. The wall opening preferably is sized and positioned for inhibiting access by a user to letter-type parcels positioned in the inner cavity. A partition is positioned between the plurality of outer walls so as to divide the inner cavity into a first compartment positionally aligned with the wall opening for inserting letter-type parcels therein through the wall opening and a second compartment for inserting larger box-type parcels therein through the open upper end of the base. An outer lid is pivotally connected to upper peripheries of the base, and the outer lid is positioned to overlie the open end of the base and abuttingly contact upper peripheries of the base when in a closed position and positioned to extend upwardly away from the base when in an open position so as to provide access to the first and second compartments through the open end.

Also, the first compartment of a parcel delivery apparatus according to the present invention preferably may have upper portions positionally aligned with the wall opening and have an increased distance between the at least one of the plurality of outer walls and the partition. This increased distance advantageously provides increased lateral depth to upper portions of the first compartment for more easily inserting letter-type parcels through the wall opening into the first compartment. The position and configuration of the base of the apparatus, including the first and second compartments and the wall opening, advantageously inhibits damage to parcels positioned within the compartments from various weather conditions such as rain or snow and provides structural strength and rigidity to the apparatus during usage.

A parcel delivery apparatus according to the present invention further may have child access inhibiting means, e.g., an access inhibiting device, associated at least with the outer lid for inhibiting child access into the base. The access inhibiting device according to the present invention preferably includes child opening inhibiting means for inhibiting opening of the outer lid by a child, child inhibiting closing means for closing the outer lid so as to inhibit child access to at least one of the compartments, e.g., preferably the second compartment or the compartment receiving larger packages, and locking means for securely locking the outer lid so as to inhibit unauthorized access to at least one of the second compartments.

For example, the access inhibiting device may include a rotatable control knob sized so as to be difficult to rotate by a child's hand and preferably includes knob activating means for activating the knob, e.g., compressing the knob, to facilitate the rotating of the knob to an open position to disengage a latch on the outer lid. Once the outer lid is open, a larger-type parcel can be positioned into the second compartment. When the control knob is released, it may return to a closed position. The outer lid can then be released, and the outer lid can be securely closed. When the outer lid is closed, the control knob is also preferably rotatable to a locked position by an adult such as a postal delivery carrier for inhibiting unauthorized access to at least the second compartment. A postal customer using the parcel delivery apparatus can then unlock the outer lid by inserting a key into, or by other lock deactivating means, the access inhibiting device and the control knob can releasably return to the closed position. The postal customer can then return the control knob to the open position and open the lid for removal of the delivered parcel.

Additionally, for permanently or semi-permanently mounting of a postal delivery apparatus, the apparatus preferably includes base securing means connected to the base for securing the base to inhibit removal and transport of the base such as from a mounting surface. In a first embodiment of the base securing means according to the present invention, the base securing means advantageously inhibits removal and transport of the postal delivery apparatus from a mounting surface such as a porch or patio of residential customers by securing the bottom of the base directly to the upper surface of the porch or patio. In a second embodiment of the base securing means according to the present invention, the base securing means advantageously includes tethering means for tethering the base to a doorway. The tethering means, for example, may include a cable having one end secured to the base and having the other end positioned under a closed door with an enlarged member, e.g., weight, ball, secured to the other end.

The present invention advantageously also provides methods of delivering parcels to and removing parcels from a parcel delivery container. A method preferably includes providing a parcel delivery container having a base including at least one parcel delivery compartment, an outer lid pivotally mounted to the base, and an access inhibiting device associated with the base and the outer lid for inhibiting unauthorized access to the at least one parcel delivery compartment. The access inhibiting device is positioned from a closed position to an open position and the outer lid is opened to position a parcel into the at least one delivery compartment. The method also includes positioning the access inhibiting device to a closed position, securely closing the outer lid, and positioning the access inhibiting device to a locked position to lock the outer lid to the base.

Another method of delivering parcels to and removing parcels from a parcel delivery container according to the present invention preferably includes providing a parcel delivery container having a base including a bottom, a plurality of outer walls connected to and extending upwardly from the bottom, a substantially hollow portion positioned within inner confines of the outer walls so as to define an inner cavity having at least one parcel delivery compartment, and an open upper end positioned for providing access to the inner cavity. At least one of the plurality of outer walls includes a wall opening formed therein for inserting letter-type parcels through the wall opening into the inner cavity of the base. The wall opening is preferably sized and positioned for inhibiting access by a user to letter-type parcels positioned in the inner cavity. An outer lid is preferably pivotally mounted to the base for providing access to the inner cavity. The at least one parcel delivery compartment has upper portions positionally aligned with the wall opening and has a greater lateral depth than lower portions of the at least one parcel delivery compartment. The method further includes inserting at least distal portions of a letter-type parcel along a generally horizontal path through the wall opening and into at least portions of the at least one parcel delivery compartment and releasing the letter-type parcel so that the at least distal portions of the letter-type parcel extend downwardly into lower portions of the at least one parcel delivery compartment.

BRIEF DESCRIPTION OF THE DRAWINGS

Some of the objects and advantages of the present invention having been stated, others will become apparent as the description proceeds when taken in conjunction with the accompanying drawings in which:

FIG. 14 is an exploded view of a child inhibiting access device of a postal delivery apparatus according to the present invention;

FIG. 15 is a vertical sectional view of a child inhibiting access device of a postal delivery apparatus according to the present invention;

FIG. 16 is a fragmentary sectional view of a child inhibiting access device of a postal delivery apparatus taken along line 16—16 of FIG. 15 an illustrating an unlocked position according to the present invention;

FIG. 17 is a fragmentary sectional view of a child inhibiting access device of a postal delivery apparatus as shown in FIG. 16 and illustrating a locked position according to the present invention; and FIG. 18 is an enlarged fragmentary view of a child inhibiting access device of a postal delivery apparatus according to the present invention.

DETAILED DESCRIPTION

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation are used to indicate similar elements in alternative embodiments.

Figure 1:
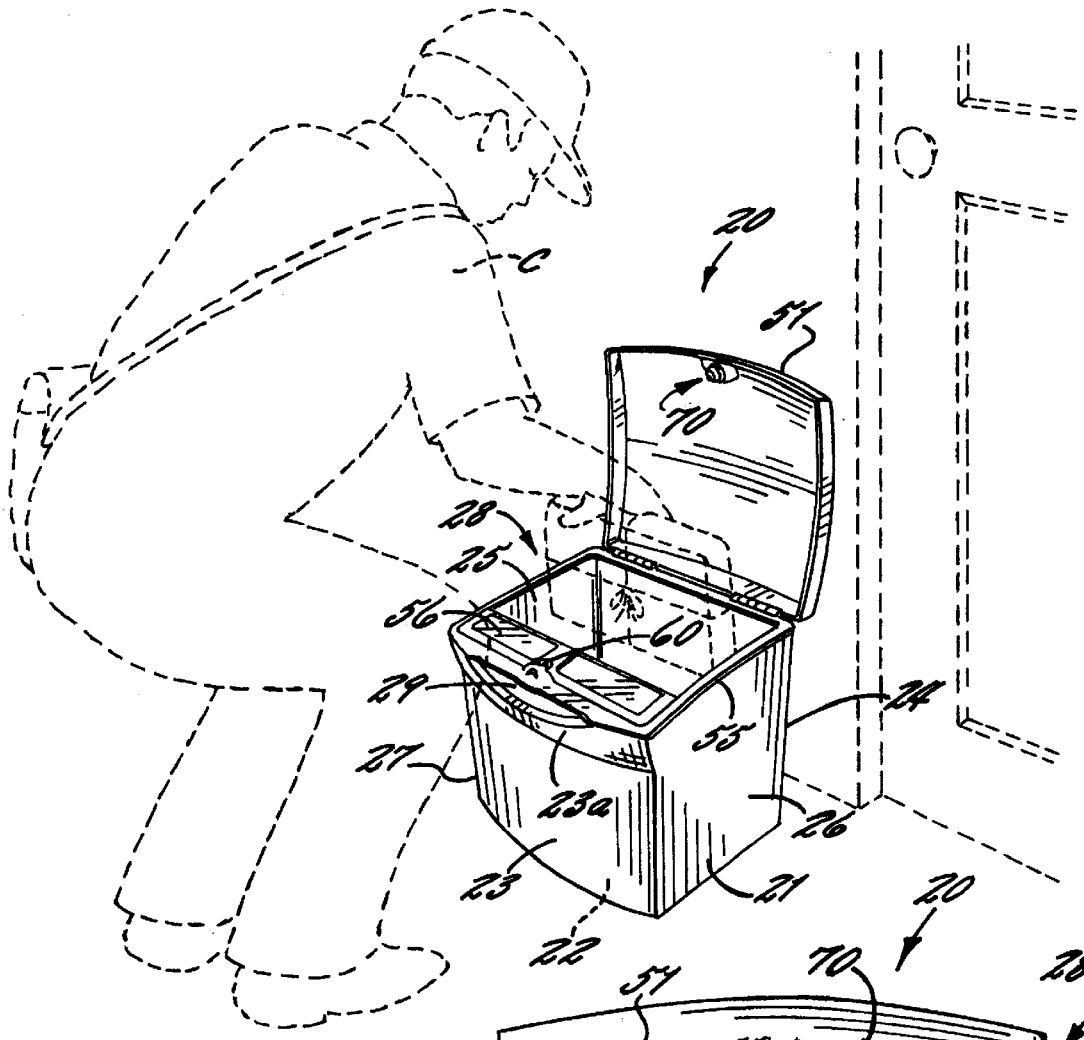
FIG. 1 is an environmental view of a postal carrier positioning a parcel into a postal delivery apparatus according to the present invention.
Figure 2:
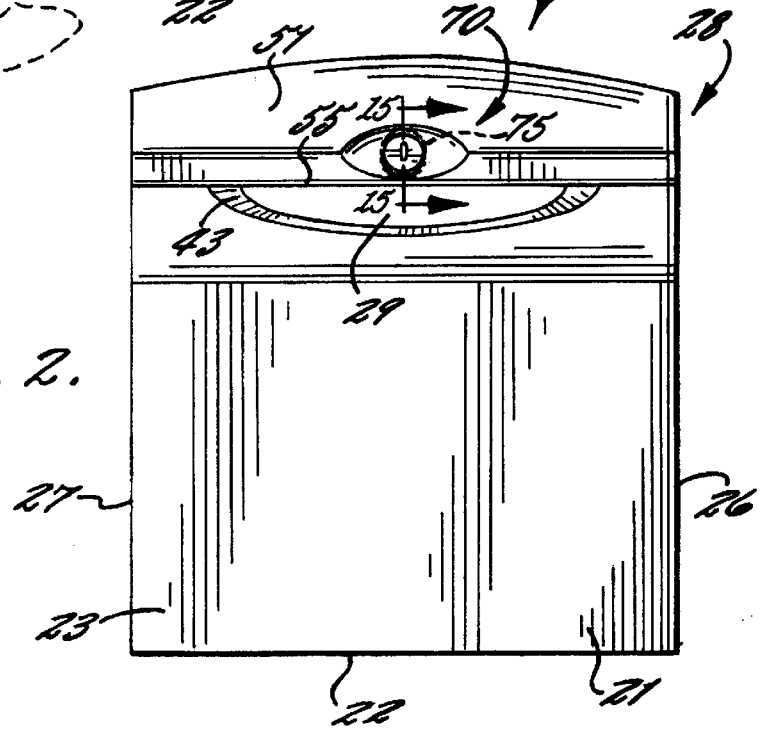
FIG. 2 is a front elevational view of a postal delivery apparatus according to the present invention.

FIG. 1 illustrates a postal carrier C positioning a parcel into a postal delivery apparatus 20 according to the present invention. The postal delivery apparatus 20 provides for a more secure delivery and removal of parcels of residential and/or commercial customers. The postal delivery apparatus 20 also allows a postal carrier C to easily and readily deliver letters and larger parcels into a delivery container which inhibits access by unauthorized individuals, including children, and without extensive delay in the delivery time. For example, the postal delivery apparatus 20 advantageously does not require a postal carrier C to carry a key or other device to access a large parcel delivery compartment, particularly for larger parcels which are often shipped by catalog companies to customers. The apparatus 20 also inhibits damage to contents from various weather conditions to which the postal delivery apparatus 20 may be exposed such as when positioned on a porch or patio of a residential customer. Because the apparatus 20 advantageously can be used by so many and such a variety of residential and commercial customers, including for example home businesses, the postal delivery apparatus 20 further preferably has structural strength, is readily manufactured in high volume, and is less expensive than other alternatives, especially for receiving larger-type parcels.

As best illustrated in FIGS. 1–8, the postal delivery apparatus 20 preferably takes the form of a container that has a base 21 including a bottom 22, front and rear outer walls 23, 24 connected to and vertically extending upward from the bottom 22, and at least a pair of side outer walls 26, 27 connected to and vertically extending upward from the bottom 22 and extending between the front and rear outer walls 23, 24. The container 20 is preferably formed of a plastic material, e.g., polymeric structural foam thermal plastic, of considerable strength and may be injection molded for ease of manufacture. Although the lower portions of the base 21, as illustrated, has a generally rectangular shape, it will be understood by those skilled in the art that other base shapes may also be used according to the present invention. The base 21 further has a base rim 55 connected to at least portions of upper peripheries of each of the front, rear, and side outer walls 23, 24, 26, 27. The base rim 55 is preferably a separate structure that may be formed of the same or different materials, and preferably is colored differently than the base 21 for aesthetic purposes and to distinguish the container 20 from other types of household containers.

A substantially hollow portion is positioned within inner confines of the bottom 22 and the front, rear, and side outer walls 23, 24, 26, 27 of the base 21 so as to define an inner cavity 25. The base 21 also has an open upper end 28 positioned for providing access to the inner cavity 25. The front outer wall 23 of the base 21 includes a lower portion connected to and vertically extending upward from the bottom 22. An upper portion is connected to upper peripheries of the lower portion and transversely extending outward therefrom. A wall opening 29, e.g., preferably an elongate slot, is formed in the upper portion of the front wall 23 for inserting letter-type parcels through the wall opening 29 into the inner cavity 25 of the base 21. The wall opening 29 preferably is sized and positioned for inhibiting access by a hand of a user to letter-type parcels positioned in the inner cavity 25. As illustrated, the wall opening 29 preferably is positioned at the combination of an upper end portion of the front wall 23 and at a proximal end portion of the top end of the container 20. This arrangement, for example, advantageously allows protection from elements easily entering the container 20 and yet allows users such as the carrier C illustrated to easily insert letter-type parcels in to the container 20.

As best shown in FIGS. 3, 5, 7, and 8, the apparatus 25 also has a vertical partition 31 connected to and extending upwardly from the base 21. The bottom 22 preferably has a partition mounting member 32 mounted to the bottom which includes an elongate entrapment groove for entrapping or confining the lower end of the partition wall therein. The partition 31 is preferably formed of metal material and stamped or pressed for structural strength. The partition 31 preferably is positioned between the front and rear outer walls 23, 24 so as to divide the inner cavity 25 into a first compartment 41 positionally aligned with the wall opening 29 for inserting letter-type parcels therein through the wall opening 29 and a second compartment 46 for inserting larger box-type parcels therein through the open upper end 28 of the base 21. The first compartment 41 advantageously has upper portions positionally aligned with the wall opening 29 and has an increased transverse or lateral distance between the upper portion of the front outer wall 23 and the partition 31 to thereby provide increased lateral depth to upper portions of the first compartment 41 for more easily inserting letter-type parcels through the wall opening 29 into the first compartment 41.

An outer lid 51 preferably is pivotally connected to upper peripheries of the rear outer wall 24 of the base 21. It will be understood by those skilled in the art, however, that other mounting positions and types would also be encompassed by the invention. The outer lid 51 preferably is positioned to overlie the open end 28 of the base 21 and abuttingly contact upper peripheries of the front, rear, and side outer walls 23, 24, 26, 27 when in a closed position and positioned to extend upwardly away from the base when in an open position so as to provide access to the first and second compartments 41, 46 through the open end 28.

Figure 3:
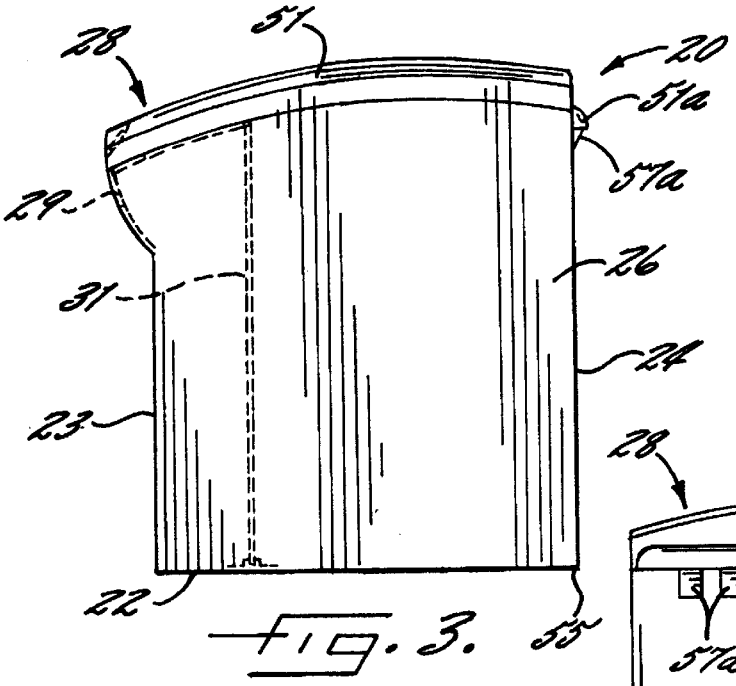
FIG. 3 is a side elevational view of a postal delivery apparatus according to the present invention and illustrating a partition of the apparatus in phantom lines.
Figure 4:
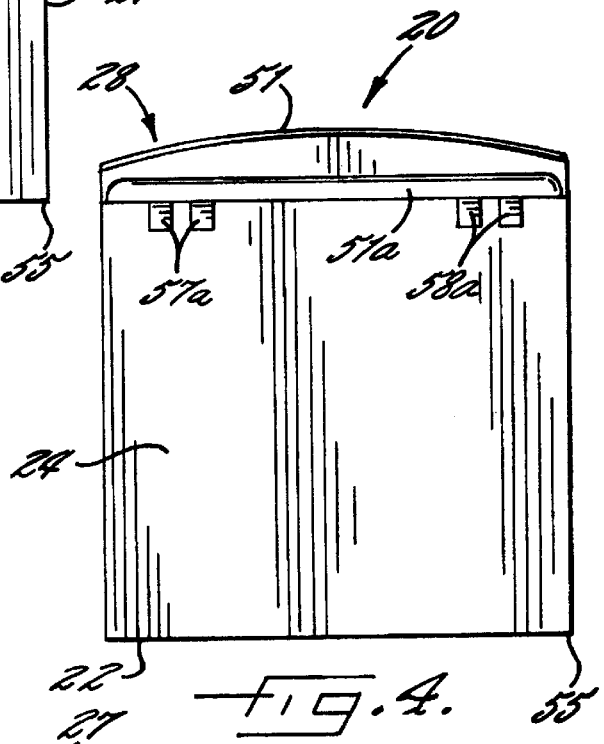
FIG. 4 is a rear elevational view of a postal delivery apparatus according to the present invention.
Figure 5:
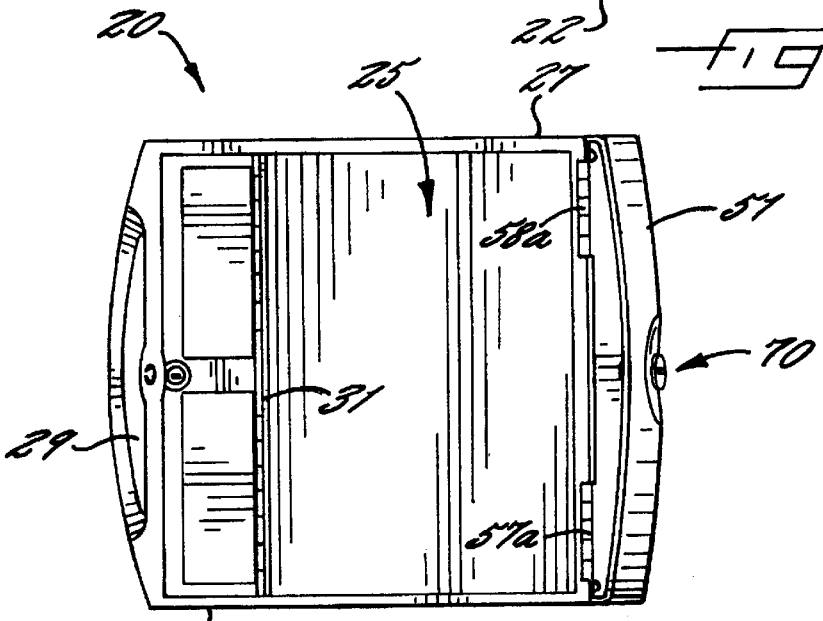
FIG. 5 is a top plan view of a postal delivery apparatus having a lid thereof positioned in an open position according to the present invention.
Figure 6:
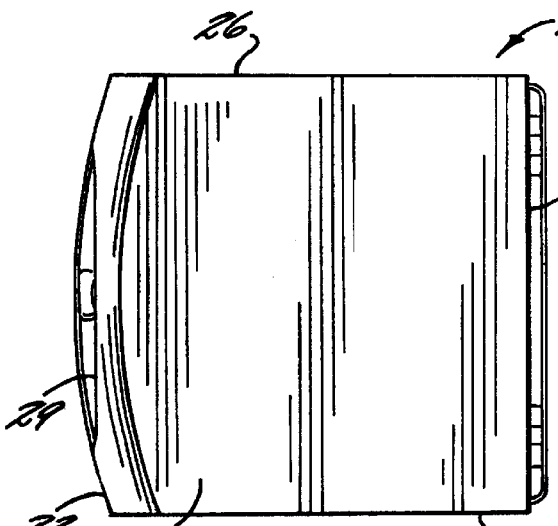
FIG. 6 is a bottom plan view of a postal delivery apparatus having a lid positioned in a closed position according to the present invention.
Figure 9:
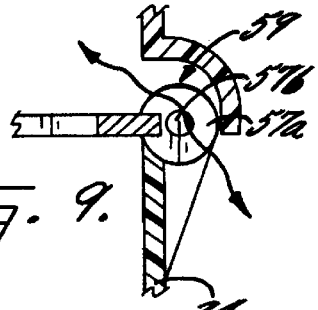
FIG. 9 is a fragmentary vertical sectional view of a mounting hinge of a postal delivery apparatus according to the present invention.

As best illustrated in FIGS. 4–5, 7, and 9, the pivotal mounting of the outer lid 51 is preferably by a plurality of mounting hinges 57*a*, 58*a* which include corresponding hinge pins 57*b*, 58*b* formed and mounted with respect to a hinge hood member 59*a* connected to, and preferably integrally formed with, the outer lid 51 so as to advantageously provide a protected channel 59 extending from the inner cavity 25 to the ambient environment for providing ventilation to the inner confines of the base 21 and inhibit the inner confines from being a completely unventilated or airtight space when the outer lid 51 is securely closed. The rear outer wall 24 has a higher vertical extent than the front outer wall 23, and the outer lid 51 convexly extends from upper peripheries of the rear wall 24 to upper peripheries of the upper portion 23*a* of the front outer wall 23 for enhancing drainage of liquid from the outer lid 51 when exposed to various weather conditions such as rain, sleet, or snow. Preferably, as best illustrated in FIG. 3, the side outer walls 26, 27 have arcuate or convex upper peripheries which abuttingly contact and mate with lower surface side peripheries of the outer lid 51. Also, the upper portion 23a of the front outer wall 23 convexly extends outward from the pair of side outer walls 26, 27 to form an enlarged and bulbous area at the front portion of the container 20.

The wall opening 29 of the front outer wall 23, as described previously, preferably is a transversely extending elongate slot, e.g., to facilitate letter-type parcels, having lower slot peripheries formed by upper peripheries of the front outer wall 23 and having upper slot peripheries formed by lower peripheries of a front overlying portion of the outer lid 51. The lower slot peripheries include an upwardly extending ridge 43 recessed from the outer surface of the front outer wall 23 for further inhibiting access by a user to lower portions of the first compartment 41 and for further inhibiting damage to letter-type parcels positioned in the first compartment 41 when exposed to various weather conditions. The position and configuration of the slot 29 and the ridge 43 provides the added protection described without the necessity of additional costly and complex covers for the slot 29.

The apparatus 20 additionally includes an inner lid 56, e.g. preferably also formed of metal material, having at least portions thereof pivotally mounted to the partition 31 and positioned to overlie the first compartment 41 when in a closed position for inhibiting access thereto and positioned to extend upwardly away from the partition 31 when in an open position for removal of letter-type parcels therefrom. The apparatus 20 further has inner lid securing means 60, associated with the inner lid 56 for securing the inner lid 56 to the base 21 when in a closed position. Front portions of the base rim 55 underlie and abuttingly contact the inner lid 56. The base rim 55 of the base 21 also preferably has front, rear, and side portions thereof which underlie and abuttingly contact the outer lid 51 as illustrated. The base rim 55 provides, for example, mounting means for portions of the inner lid securing means 60 and outer lid securing means 70, described further herein. This advantageously positions the locking interface 62, e.g., locking interface hardware, of the inner and outer lids 51, 56 within the inner confines of the base 21 to inhibit damage from exposure to various weather conditions and from unauthorized individuals attempting access to the inner confines of the base 21.

As best illustrated in FIGS. 10–13, base securing means 90 is connected to the base 21 for securing the base to inhibit removal and transport of the base 21. In a first embodiment of the base securing means 90 according to the present invention, the base securing means 90, e.g., concrete or wood screw 91 having an eyelet 92 extending into the second compartment 46 and a lock 93 positioned through the eyelet 92, advantageously inhibits removal and transport of the postal delivery apparatus 20 from a mounting surface such as a porch or patio of residential customers by securing the bottom 22 of the base 21 directly to the upper surface of the porch or patio. The screw 91 extends through the bottom 22 of the base 21 and into a portion of the mounting surface. This embodiment advantageously allows the base to be readily mounting to a variety of mounting surfaces and to be position in a variety of locations in and around the premises of a residential or commercial customer. It will also be understood by those skilled in the art that other configurations, e.g., bolts, mounting tracks, mounting shelves, etc., may be used to secure the container 20 to a mounting surface such as a porch, patio, or wall.

In a second embodiment of the base securing means 90' according to the present invention (FIGS. 12–13), the base securing means 90' advantageously includes tethering means 95', e.g., a tether mount device, for tethering the base 21 to a doorway. The tethering means 90', for example, may include a cable 96', e.g., formed of stainless steel, having a proximal end secured to the base 21 such as by a tether adjusting member 99 and having a distal end positioned under a closed door with an enlarged member 97', e.g., disc, puck, weight, or ball, secured to the distal end. The second embodiment advantageously allows the container 20 to be positioned in or around a doorway without requiring any special mounting to a mounting surface. This is advantageously, for example, where penetration of a mounting surface is not desired.

Figure 8:
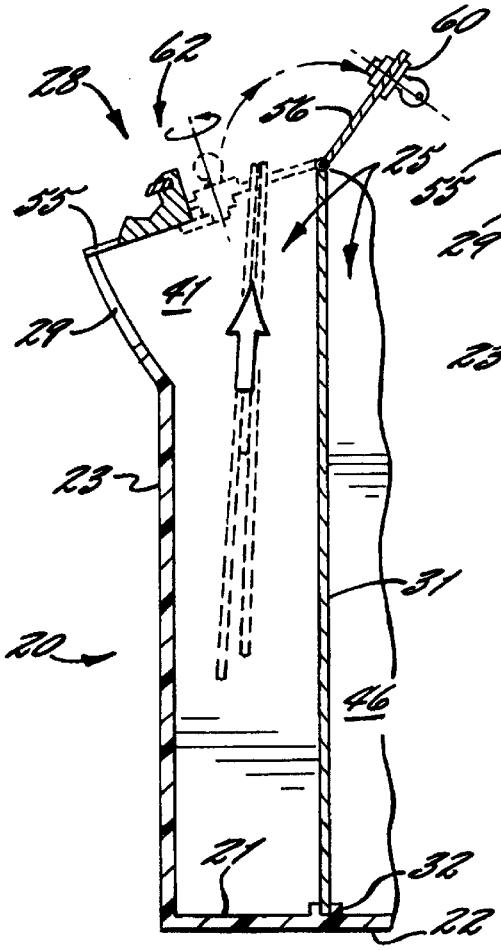
FIG. 8 is a fragmentary vertical sectional view of a postal delivery apparatus according to the present invention.
Figure 7:
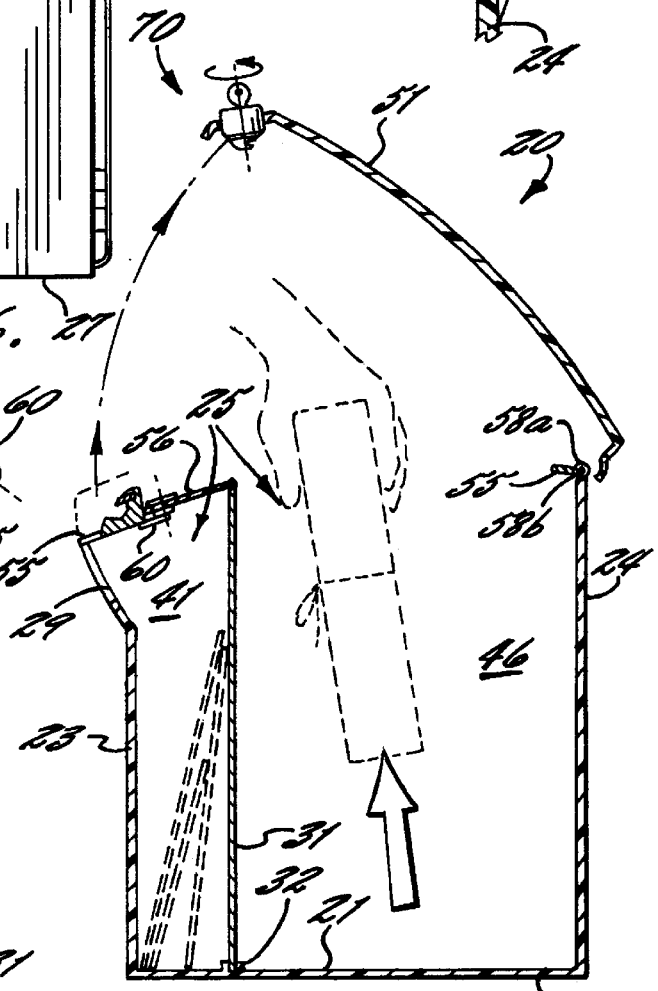
FIG. 7 is a fragmentary vertical sectional view of a postal delivery apparatus according to the present invention.
Figure 10:
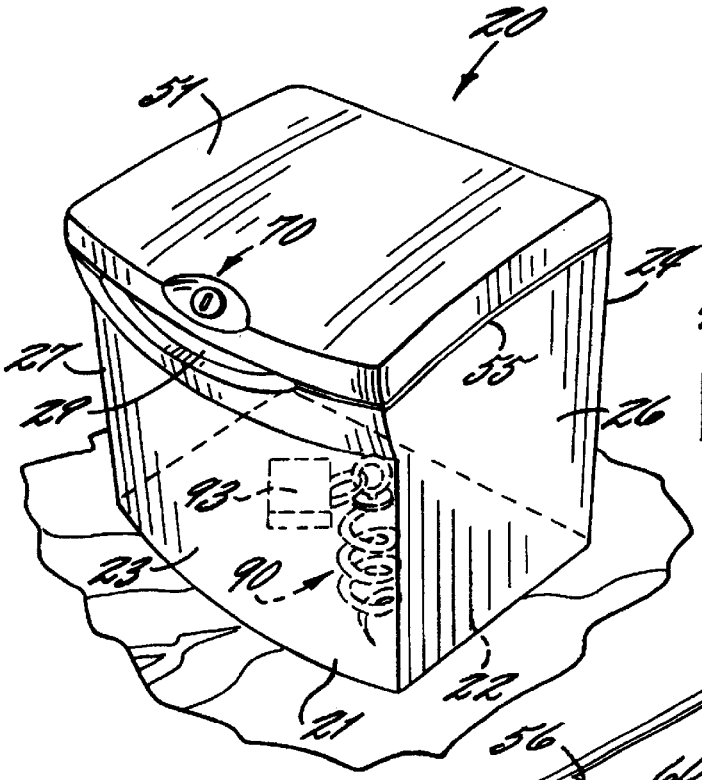
FIG. 10 is a perspective view of a postal delivery apparatus secured to a mounting surface according to a first embodiment of the present invention.
Figure 11:
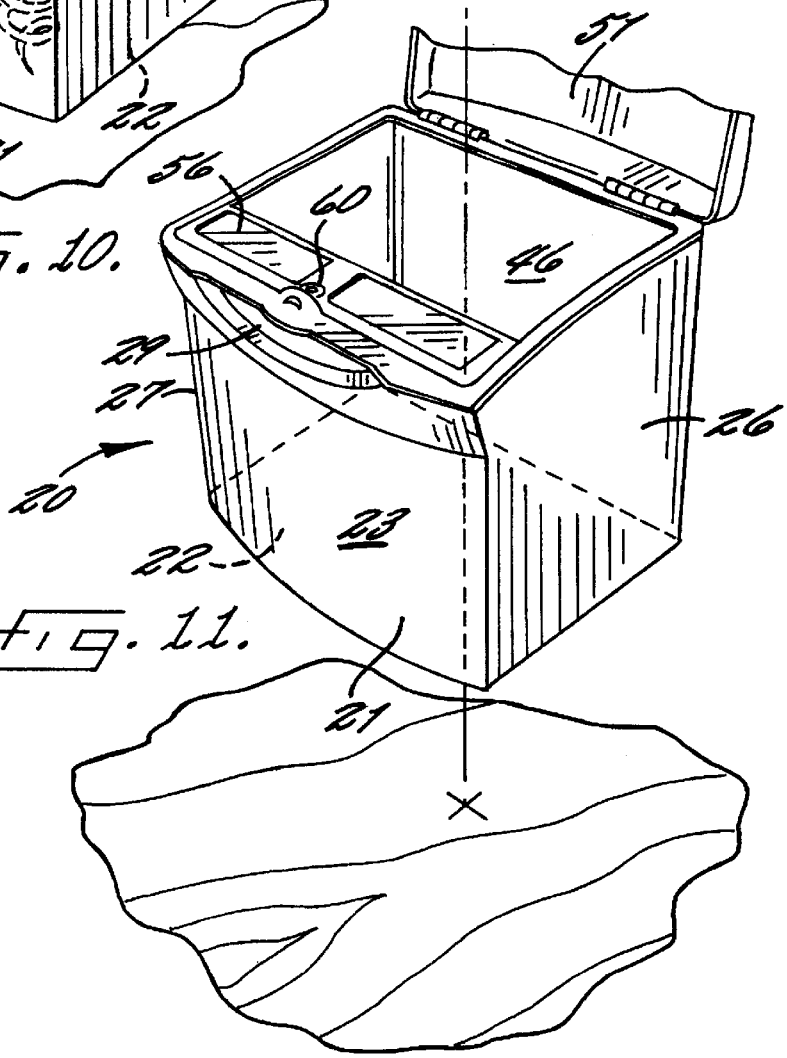
FIG. 11 is an exploded sectional view of a base securing device of a postal delivery apparatus according to a first embodiment of the present invention.
Figure 12:
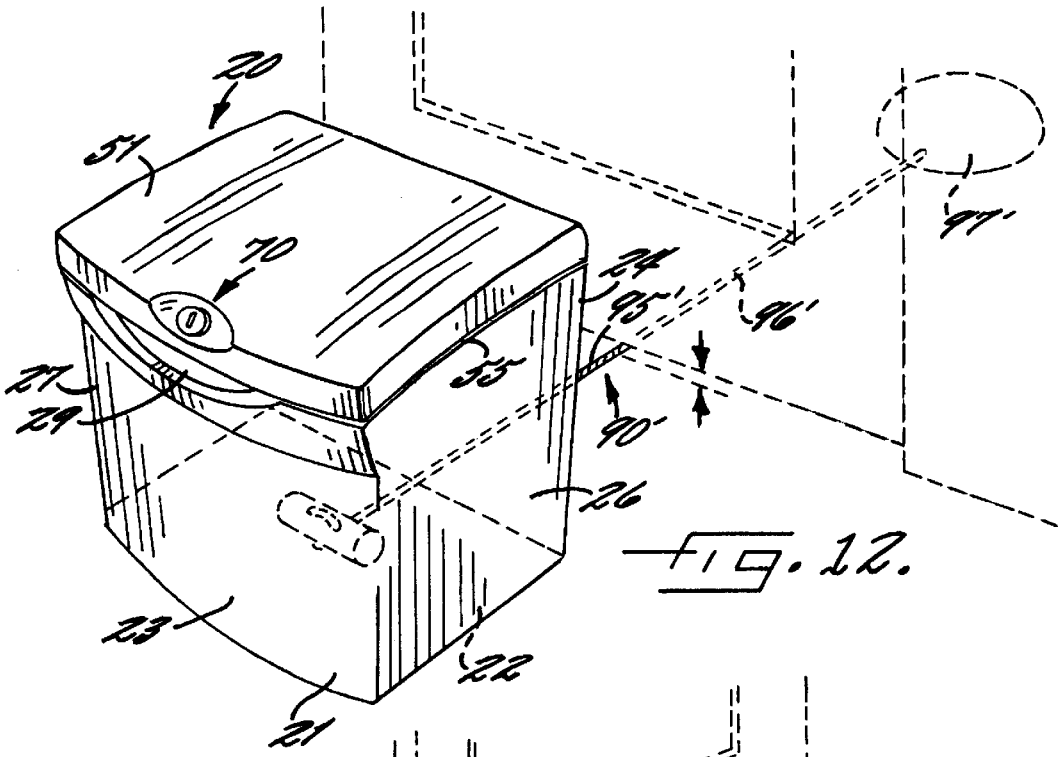
FIG. 12 is a perspective view of a postal delivery apparatus secured to a doorway according to a second embodiment of the present invention.
Figure 13:
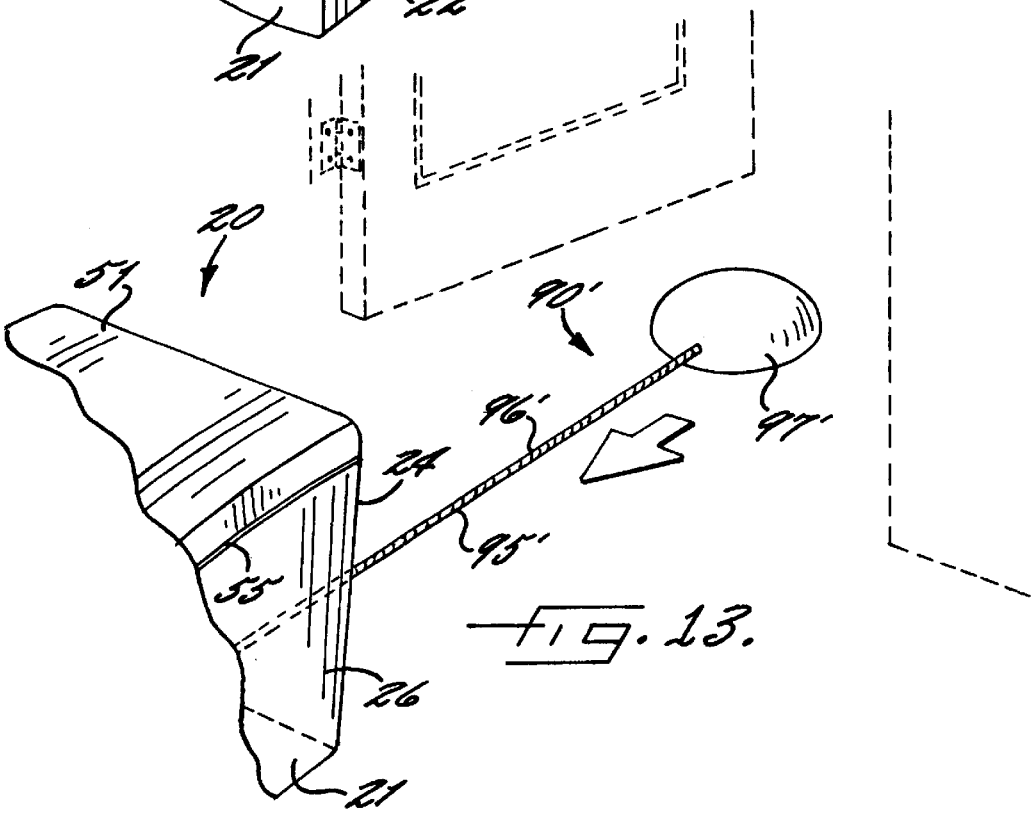
FIG. 13 is a fragmentary perspective view of a base securing device of a postal delivery apparatus according to a second embodiment of the present invention.

Also, as best illustrated in FIGS. 7–8 and 14–18, the postal delivery apparatus 20 advantageously includes outer lid securing means 70, e.g., a lock responsive to a designated key, a security keypad, or remote transmitter, connected to the outer lid 51 and the base 21 for securing the outer lid 51 to the base 21 when in a closed position. The inner and outer lid securing means 60, 70 preferably use the same customer designated key or access scheme for providing access to the first and second compartments. The outer lid securing means 70 can therefore advantageously be provided by a lock, for example, responsive to a designated key. As best illustrated in FIGS. 7–8, and as understood by those skilled in the art, the designated key can advantageously be used to engage the lock of the outer lid securing means 70 and can also advantageously be used to engage the inner lid securing means 60. The outer lid securing means 70 preferably includes child access inhibiting means 80, e.g., a child access inhibitor, associated with the outer lid 51 for inhibiting child access to the inner cavity 25 of the base 21 (see FIG. 18). The child access inhibiting means 80 preferably includes child opening inhibiting means 82 responsive to an adult user such as a postal carrier C for inhibiting opening of the outer lid 51 by a child, locking means 84 responsive to an adult postal carrier for securely locking the outer lid 51 so as to inhibit unauthorized access to the container responsive to activation of the locking means 84, and closing means 86 responsive to the locking means 84 and the child opening inhibiting means 82 for securely closing of the outer lid 51 so as to inhibit child access to the inner cavity 25 of the base 21.

The child inhibit opening means 82 of the child access inhibitor is preferably provided by a control knob 81 rotatably mounted to the container 20 for rotating the child access inhibitor to an open position to releasably open the outer lid 51. Therefore, the control knob 81 of child access inhibitor includes an open position, as illustrated in FIG. 18. The child inhibit closing means 86 of the child access inhibitor can also advantageously be provided by the control knob 81. The control knob 81 can therefore also include a closed position for closing the outer lid 51 as best illustrated in FIG. 18. The locking means 84 includes the control knob 81 being rotatable to a locked position for locking the lid 51 to the base 21. As set forth above, the locking means or the outer lid securing means can advantageously be provided by a lock that is operable with a key. The outer lid 51 may also include a recessed portion 52 formed on an outer surface thereof, and the control knob 81 preferably is rotatably mounted to the recessed portion 52 of the lid 51. The control knob 81 is also preferably required to be pushed inward during rotation to further inhibit child access and to disengage the lock arrangement.

For example, the access inhibiting device 80 preferably includes the rotatable control knob 81 being sized so as to be difficult to rotate by a child's hand and preferably including knob activating means 83, e.g., a compressible knob, for activating the knob responsive to an appropriately sized and strong hand of a user, e.g., adult, to facilitate the rotating of the knob 81 to an open position. For example, typically, a young child, e.g., a child under the age of 6, may have difficulties operating certain mechanisms, such as a car door because it may be too high and require too much strength for the child to open, or the handle on a refrigerator door because of the force required to pull the door open. In some instances, however, knobs or handles can be provided to certain devices to allow for child access, e.g., a handle on a child's toy car door can be readily opened by a child. Similarly, the control knob 81 of the access inhibiting device 80 can have a predetermined size and require a predetermined amount of force to be operated by an adult, such as a postal carrier C, but not by a child. The larger the size of the control knob 81, the less likely it will be that a child can gain access to the postal delivery apparatus 20. This is because a child's hand is generally smaller than that of an average adult. The average adult will more likely be able to grip a larger sized control knob 81, than will the average child's hand. This advantageously enhances the safety of the postal delivery apparatus 20. More particularly, the access inhibiting device 80 includes upper and lower lock interfaces 100, 110 as an embodiment of this lock arrangement for engaging and disengaging the outer lid 51 from the base 21. The upper lock interface 100 preferably includes a locking cylinder 101 which can be unlocked by portions of a key inserted into a proximal opening 102 formed in the locking cylinder 101. As understood by those skilled in the art, the locking cylinder 101 preferably has upper portions thereof which rotate, e.g., clockwise, to a locked position separate from lower portions thereof. The lower portions or distal end portion 103 preferably rotates, e.g., counterclockwise; as an integral unit with the upper portions of the locking cylinder 101 for opening and closing, but not locking, the outer lid 51 (as best illustrated in FIGS. 15–16). Therefore, the child access inhibiting means can advantageously be provided by the access inhibiting device 80. As described above and as best illustrated in FIGS. 14–18, the access inhibiting device can advantageously be provided by the control knob 81.

The distal end portion 103 of the locking cylinder 101 preferably has a channel 104 formed therein. The channel 104 preferably engages a tongue member 115 of the lower lock interface 110 which is engaged when a distal end 105, e.g., camming-type member, of the locking cylinder 101 is positioned into a lock base opening 112 formed in the lock base 111 of the lower lock interface 110. The tongue member 115 is preferably positioned to extend outwardly and downwardly from an upper end portion 113 of the lock base 111 as illustrated. The lock base 111 preferably has a bulbous shape and extends upwardly from the base rim 55 or the upper end portion of the base 21.

A locking cylinder cover 75 is preferably positioned to overlie the locking cylinder 101 for gripping and rotating the locking cylinder 101 by a user. The cover 75 is preferably formed of a polymeric material and can also advantageously be used to protect the locking cylinder 101 from damage due to exposure to various weather elements. As understood by those skilled in the art, to further inhibit child access, the cover 75 can also advantageously be arranged to only rotate the locking cylinder 101 when properly gripped (see FIG. 18) and squeezed, such as by an adult hand, before rotation can be accomplished. Such covers for further inhibiting child access are conventional and would be readily understood by those skilled in the art. Icons or position indicators, are preferably integrally formed with or attached to the outer lid 51 or cover 75.

Once the outer lid 51 is open, a larger-type parcel can be positioned into the second compartment 46. When the control knob 81 is released, it may return to a closed position. The outer lid 51 can then be released, and the outer lid 51 can be securely closed by setting down or dropping the lid 51 onto upper peripheries of the base 21. When the outer lid 51 is closed, the control knob 81 is also preferably rotatable to a locked position by an adult such as a postal delivery carrier C for inhibiting unauthorized access to at least the second compartment 46, and preferably to the first compartment 41 as well. A postal customer using the parcel delivery apparatus 20 can then unlock the outer lid 51 by inserting a key into, or by other lock deactivating means, the access inhibiting device and the control knob 81 can releasably return, e.g., spring back, reset, to the closed position. The postal customer can then return the control knob 81 to the open position and open the outer lid 51 for removal of the delivered parcel in the second compartment 46. The customer can also then have access to the inner lid locking means 60 and unlock the inner lid 56 to gain access to the first compartment 41 to remove, for example, letter-type parcels positioned therein. As understood by those skilled in the art, other child access inhibiting means 80 may be used as well. The preferred device or means 80 according to the present invention, however, advantageously inhibits child access and yet provides a structure and function that allows a carrier C to easily deliver and secure packages into a container 20 after the package is delivered without the requirement of a carrier carrying a key for the container. The owner of the container 20 can then maintain control over the key or other unlock scheme, e.g., coded password or unlocking protocol for electronic and mechanical locking arrangements, to unlock and open the container 20 for removal of parcels positioned and securely maintained therein.

As best illustrated in FIGS. 1–18, the present invention also includes methods of delivering parcels to and removing parcels from a parcel delivery container 20 having at least one parcel delivery compartment 46, and preferably a pair of parcel delivery compartments 41, 46 as illustrated. A method preferably includes positioning an access inhibiting device 80, e.g, rotating, from a closed position to an open position so as to provide access to the at least one parcel delivery compartment 46 and positioning a parcel into the at least one parcel delivery compartment. The access inhibiting device 80 is then positioned, e.g., rotated, to a closed position so as to inhibit access to the at least one parcel delivery compartment 46 by a child. The access inhibiting device 80 can be positioned, e.g., rotated, to a locked position so as to prevent unauthorized access to the at least one parcel delivery compartment 46. This method may also include unlocking the access inhibiting device 80 and positioning the access inhibiting device 80 to the closed position responsive to unlocking the access inhibiting device 80. This method may further include positioning the access inhibiting device 80 to the open position so as to provide access to the at least one parcel delivery compartment 46 and removing the parcel positioned therein from the at least one parcel delivery compartment 46.

Another method according to the present invention preferably includes providing a parcel delivery container 20 having a base 21 including a bottom 22, a plurality of outer walls 23, 24, 26, 27 connected to and extending upwardly from the bottom 22, a substantially hollow portion positioned within inner confines of the outer walls so as to define an inner cavity 25 having at least one parcel delivery compartment 41, and an open upper end positioned for providing access to the inner cavity 25. At least one 23 of the plurality of outer walls 23, 24, 26, 27 includes a wall opening 29 formed therein for inserting letter-type parcels through the wall opening 29 into the inner cavity 25 of the base 21. The wall opening 29 is sized and positioned for inhibiting access by a user to letter-type parcels positioned in the inner cavity 25, and the outer lid 51 is pivotally mounted to the base 21 for providing access to the inner cavity 25. The at least one parcel delivery compartment 41 has upper portions positionally aligned with the wall opening 29 and has a greater lateral depth than lower portions of the at least one parcel delivery compartment 41. This method also includes inserting at least distal portions of a letter-type parcel along a generally horizontal path through the wall opening 29 and into at least portions of the at least one parcel delivery compartment 41 and releasing the letter-type parcel so that the at least distal portions of the letter-type parcel extend downwardly into lower portions of the at least one parcel delivery compartment 41. This method may also include the container 20 further having an access inhibiting device 80 associated with the base 21 and the outer lid 51 for inhibiting unauthorized access to the at least one parcel delivery compartment 41 and the method further including positioning the access inhibiting device 80 for opening the outer lid 51 and removing a letter-type parcel from the at least one parcel delivery compartment. As illustrated in these multiple compartment embodiments, the inner lid 56 preferably is unlocked and also opened to remove a letter-type parcel from the first compartment 41. The second compartment 46 does not have the inner lid 56 overlying and/or inhibiting access to the second compartment 46 so as to provide a drop-off location or compartment 46 for a postal carrier C for larger-type parcels.

In the drawings and specification, there have been disclosed a typical preferred embodiment of the invention, and although specific terms are employed, the terms are used in a descriptive sense only and not for purposes of limitation. The invention has been described in considerable detail with specific reference to these illustrated embodiments. It will be apparent, however, that various modifications and changes can be made within the spirit and scope of the invention as described in the foregoing specification and as defined in the appended claims.

That which is claimed:

1. A postal delivery apparatus comprising:

a base including a substantially hollow portion positioned within inner confines of said base so as to define an inner cavity and an open upper end positioned for providing access to the inner cavity, a wall opening formed in said base for inserting letter-type parcels through the wall opening into the inner cavity of said base, the wall opening being sized and positioned for inhibiting access by a user to letter-type parcels positioned in the inner cavity;

an outer lid pivotally connected to upper peripheries of said base, said outer lid being positioned to overlie the open end of said base and abuttingly contact upper peripheries of said base when in a closed position and positioned to extend upwardly away from said base when in an open position so as to provide access to the inner cavity through the open end; and a child access inhibiting device associated at least with said outer lid for inhibiting child access into said base, said child access inhibiting device being movable to an open position, a closed position different from said open position, and a locked position different from both of said open and closed positions and including outer lid securing means for securely locking said outer lid so as to prevent unauthorized positioning of said child access inhibiting device in either the open or closed positions and thereby inhibit unauthorized access to the inner cavity by adults and children, and a control knob rotatably mounted to the postal delivery apparatus for rotating to said open position to releasably open said outer lid, said closed position for closing said outer lid, and said locked position wherein the outer lid securing means securely locks said outer lid to said base.

2. A postal delivery apparatus as defined in claim 1, wherein upper portions of the inner cavity positionally align with said wall opening and include an increased lateral depth to the lower portions for more easily inserting letter-type parcels through the wall opening into the upper portion of the inner cavity of said base.

3. A postal delivery apparatus as defined in claim 2, further comprising an inner lid having at least portions thereof pivotally mounted to said base and positioned to overlie the inner cavity when in a closed position for inhibiting access thereto and positioned to extend upwardly away from said base when in an open position for removal of letter-type parcels therefrom.

4. A postal delivery apparatus as defined in claim 3, further comprising base securing means connected to said base for securing said base to inhibit removal and transport of said base.

5. A postal delivery apparatus as defined in claim 4, further comprising inner lid securing means associated with said inner lid for securing said inner lid to said base when in a closed position.

6. A postal delivery apparatus as defined in claim 5, wherein said base further comprises a base rim connected to at least portions of upper peripheries of each said plurality of outer walls, portions of said base rim underlying and contacting said inner lid.

7. A postal delivery apparatus as defined in claim 6, wherein said wall opening of the at least one of said plurality of outer walls comprises a transversely extending elongate slot having lower slot peripheries formed by upper peripheries of the at least one of said plurality of outer walls and having upper slot peripheries formed by lower peripheries of an adjacent and overlying portion of said outer lid.

8. A postal delivery apparatus as defined in claim 7, wherein the lower slot peripheries include an upwardly extending ridge recessed from an outer surface of the at least one of said plurality of outer walls for inhibiting access by a user to lower portions of the first compartment and for inhibiting damage to letter-type parcels positioned in the first compartment from various weather conditions.

9. A postal delivery apparatus as defined in claim 8, wherein an outer wall positioned opposite the at least one of said plurality of outer walls has a higher vertical extent than the at least one of said plurality of outer walls, and wherein said outer lid convexly extends from upper peripheries of the higher vertically extending outer wall to upper peripheries of the at least one of said plurality of outer walls having said wall opening formed therein for enhancing drainage of liquid from said outer lid under various weather conditions.

10. A parcel delivery apparatus comprising:

a container including a base having an inner cavity sized for positioning parcels therein and a lid pivotally mounted to said base for pivoting from a closed position overlying and abuttingly contacting upper peripheries of said base to an open position extending outwardly from said base so as to provide access to the inner cavity; and a child access inhibiting device associated with said container for inhibiting child access into said container, said child access inhibiting device includes outer lid securing means responsive to an adult postal carrier for securely locking said lid so as to inhibit unauthorized access to said container responsive to activation of said outer lid securing means, and a control knob rotatably mounted to said container for rotating to an open position to releasably open said lid, said control knob further being rotatable to a closed position for closing said lid, and wherein said outer lid securing means includes said control knob being rotatable to a locked position for locking said lid to said base.

11. A postal delivery apparatus as defined in claim 10, further comprising base securing means connected to said bottom of said base for securing said base to inhibit removal and transport of said base from a mounting surface.

12. An apparatus as defined in claim 11, wherein said lid includes a recessed portion formed on an outer surface thereof and said control knob being rotatably mounted to said recessed portion of said lid.

13. An apparatus as defined in claim 12, wherein said base includes a bottom, front and rear outer walls connected to and vertically extending upward from said bottom, at least a pair of side outer walls connected to and vertically extending upward from said bottom and extending between said front and rear outer walls, a substantially hollow portion positioned within inner confines of said front, rear, and side outer walls so as to define the inner cavity, and an open upper end positioned for providing access to the inner cavity, said front outer wall of said base including a lower portion connected to and vertically extending upward from said bottom, an upper portion connected to upper peripheries of said lower portion and transversely extending outward therefrom, and a wall opening formed in the upper portion of said front wall for inserting letter-type parcels through the wall opening into the inner cavity of said base, the wall opening being sized and positioned for inhibiting access by a user to letter-type parcels positioned in the inner cavity.

14. An apparatus as defined in claim 13, wherein said container further comprises a vertical partition connected to and extending upwardly from said bottom of said base and positioned between said front and rear outer walls so as to divide the inner cavity into a first compartment positionally aligned with the wall opening for inserting letter-type parcels therein through the wall opening and a second compartment for inserting larger box-type parcels therein through the open upper end of said base.

15. A postal delivery apparatus as defined in claim 14, wherein the first compartment has upper portions positionally aligned with said wall opening and having an increased distance between the upper portion of said front outer wall and said partition to thereby provide increased lateral depth to upper portions of the first compartment for more easily inserting letter-type parcels through the wall opening into the first compartment.

16. A postal delivery apparatus as defined in claim 15, further comprising an inner lid having at least portions thereof pivotally mounted to said partition and positioned to overlie the first compartment when in a closed position for inhibiting access thereto and positioned to extend upwardly away from said partition when in an open position for removal of letter-type parcels therefrom and inner lid securing means associated with said inner lid for securing said inner lid to said base when in a closed position.

17. A postal delivery apparatus as defined in claim 16, wherein said base further comprises a base rim connected to at least portions of upper peripheries of each said front, rear, and side outer walls, front portions of said base rim underlying and contacting said inner lid.

18. A postal delivery apparatus as defined in claim 17, wherein said wall opening of the front outer wall comprises a transversely extending elongate slot having lower slot peripheries formed by upper peripheries of the front outer wall and having upper slot peripheries formed by lower peripheries of a front overlying portion of said outer lid, the lower slot peripheries including an upwardly extending ridge recessed from the outer surface of the front outer wall for inhibiting access by a user to lower portions of the first compartment and for inhibiting damage to letter-type parcels positioned in the first compartment from various weather conditions.

19. A postal delivery apparatus comprising:

a base including a substantially hollow portion positioned within inner confines of said base so as to define an inner cavity and an open upper end positioned for providing access to the inner cavity, a wall opening formed in said base for inserting letter-type parcels through the wall opening into the inner cavity of said base, the wall opening being sized and positioned for inhibiting access by a user to letter-type parcels positioned in the inner cavity;

an outer lid pivotally connected to upper peripheries of said base, said outer lid being positioned to overlie the open end of said base and abuttingly contact upper peripheries of said base when in a closed position and positioned to extend upwardly away from said base when in an open position so as to provide access to the inner cavity through the open end; and child access inhibiting means associated with at least the outer lid for inhibiting child access into said base, said child access inhibiting means comprising a child access inhibiting device mounted to the postal delivery apparatus and having an open position to releasably open said outer lid, a closed position different from the open position to releasably close said outer lid, and a locked position different from both the open and closed positions to securely lock said outer lid to said base.

20. The postal delivery apparatus as defined in claim 19, wherein the child access inhibiting device further comprises a control knob rotatably mounted to the postal delivery apparatus and being selectively movable to said open position, said closed position, and said locked position.

* * * * *